US007895695B2

(12) United States Patent
Bernini et al.

(10) Patent No.: US 7,895,695 B2
(45) Date of Patent: Mar. 1, 2011

(54) TOOTH-CLEANING DEVICE

(75) Inventors: Michele Bernini, Parma (IT); Tommaso Ravasini, Parma (IT)

(73) Assignee: S K G Italia S.p.A., Parma (IT)

( * ) Notice: Subject to any disclaimer, the term of this patent is extended or adjusted under 35 U.S.C. 154(b) by 1241 days.

(21) Appl. No.: 10/511,982

(22) PCT Filed: Apr. 24, 2002

(86) PCT No.: PCT/EP02/04544

§ 371 (c)(1),
(2), (4) Date: Mar. 28, 2005

(87) PCT Pub. No.: WO03/090578

PCT Pub. Date: Nov. 6, 2003

(65) Prior Publication Data

US 2005/0172435 A1 Aug. 11, 2005

(51) Int. Cl.
*A47L 13/17* (2006.01)

(52) U.S. Cl. ..... 15/104.94; 15/167.1

(58) Field of Classification Search ..... 15/104.94, 15/167.1, 227, 22.7, 106; 401/132, 6, 183; 206/362.2, 361, 368, 229
See application file for complete search history.

(56) References Cited

U.S. PATENT DOCUMENTS

| | | | | |
|---|---|---|---|---|
| 2,186,005 | A * | 1/1940 | Casto | 15/167.1 |
| 2,396,548 | A * | 3/1946 | Allen | 15/167.1 |
| 2,978,724 | A * | 4/1961 | Gracian | 15/167.1 |
| 3,188,673 | A * | 6/1965 | Newman | 15/167.1 |
| 3,302,230 | A * | 2/1967 | Poppelmann | 15/167.1 |
| 4,292,705 | A | 10/1981 | Stouffer | 15/110 |
| 5,261,426 | A * | 11/1993 | Kellett et al. | 132/108 |
| 5,283,924 | A * | 2/1994 | Kaminski et al. | 15/244.1 |
| 5,392,482 | A * | 2/1995 | Drulias et al. | 15/104.94 |
| 5,765,252 | A * | 6/1998 | Carr | 15/104.94 |
| 6,116,252 | A * | 9/2000 | Stelmach | 132/309 |
| 6,119,296 | A * | 9/2000 | Noe et al. | 15/104.94 |
| 6,721,987 | B2 * | 4/2004 | McDevitt et al. | 15/227 |
| 6,722,805 | B1 * | 4/2004 | Skinner | 401/132 |
| 6,808,068 | B2 * | 10/2004 | Abada | 206/362.2 |
| 6,874,194 | B1 * | 4/2005 | Harris | 15/227 |
| RE39,185 | E * | 7/2006 | Noe et al. | 15/104.94 |
| 7,234,192 | B2 * | 6/2007 | Barbar | 15/167.1 |
| 7,629,043 | B2 * | 12/2009 | Lindsay et al. | 428/316.6 |
| 2002/0170133 | A1 * | 11/2002 | McDevitt et al. | 15/167.1 |
| 2003/0088930 | A1 * | 5/2003 | Abada | 15/110 |
| 2003/0135181 | A1 * | 7/2003 | Chen et al. | 604/374 |
| 2005/0136238 | A1 * | 6/2005 | Lindsay et al. | 428/304.4 |
| 2005/0172435 | A1 * | 8/2005 | Bernini et al. | 15/167.1 |
| 2009/0092563 | A1 * | 4/2009 | Allred et al. | 424/53 |
| 2009/0320226 | A1 * | 12/2009 | Robinson et al. | 15/167.1 |

FOREIGN PATENT DOCUMENTS

| | | |
|---|---|---|
| DE | 100 33 849 A1 | 1/2001 |
| EP | 0 252 0710 | 1/1988 |
| GB | 2 162 743 | 2/1986 |

* cited by examiner

*Primary Examiner*—Lee D Wilson
(74) *Attorney, Agent, or Firm*—Fattibene and Fattibene; Paul A. Fattibene

(57) ABSTRACT

The present invention relates to the field of tooth cleaning. According to the present invention a tooth cleaning device is provided, adapted to be introduced into the mouth. The tooth cleaning device can be engaged by the tongue, and this allows it to be displaced all around the mouth by the tongue, thus performing a cleaning process.

7 Claims, 7 Drawing Sheets

TOOTH-CLEANING DEVICE

FIELD OF THE PRESENT INVENTION

The present invention relates to the field of dental care and particularly to a tooth-cleaning device which can be contained and displaced in the mouth without any need of being hand-held by the user.

DESCRIPTION OF THE PRIOR ART

During the last years increasing attention has been paid toward techniques for preserving teeth, jawbone structure and gums so that they can be maintained in good condition till advanced age and possibly during the whole life span of an individual. In particular, since dental health strongly depends on dental care it is highly recommended that people should clean their teeth frequently, and possibly after every meal.

However, the most common techniques and equipment for dental care, such as, for example, hand-held tooth brushes and toothpaste require a supply of water and a sink or basin, thus preventing people exploiting dental cleaning in all those situations in which water and/or appropriate structures are not at immediate disposal.

Nowadays it is becoming more and more usual that people spend most of the day out of their houses and have several quick meals while working, travelling (for example during a flight) or exploiting similar business and/or leisure activities.

In all these situations as well as in other everyday circumstances it would be highly desirable and beneficial to have the opportunity to exploit dental cleaning, not only for health reasons but also for the purpose of refreshing the breath.

However, lack of time as well as other usual circumstances very often lead people to refrain from undertaking the necessary efforts to exploit adequate dental hygiene.

Moreover, dispensing the toothpaste on a traditional toothbrush requires both hands to be used and represents a nearly impossible task for people having limited or no upper body mobility, i.e. semi-disabled people.

Additionally, although increasing attention has been paid during the last years to the problems and/or exigencies of handicapped people (for instance people in wheelchairs) many public toilets and/or rest rooms are still not easily accessible to handicapped people, or, even if accessible, are not adequately equipped so that handicapped people are often prevented from exploiting dental cleaning in public rest rooms.

To overcome these inconveniences, many solutions have been proposed in the art, with the purpose of allowing people to carry out dental cleaning in every daily circumstance.

For instance, it has been proposed to utilize chewing gum as an aid for cleaning teeth; this has the advantage that a supply of water and a sink are not required, but chewing gum may not provide a very good degree of cleaning of a set of teeth, especially where teeth join the gums.

Several forms of handless brushes, or brush balls have been also proposed. These devices are for the purpose of insertion into the mouth, to be chewed, with extending bristles cleaning the surfaces of the teeth. One of these devices is disclosed in patent application GB 2 351 015, published on Dec. 20, 2000. This device has a resilient, collapsible, hollow spherical ball in its principle embodiment with short bristles extending outwardly so that the user can chew the ball while the brush is cleaning his teeth; the hollow ball is perforated and contains toothpaste which is dispersed as the ball is chewed.

While this may be somewhat practical, the cleaning results obtained by using chewing balls of this kind have mostly revealed to be unsatisfactory. This is due in particular to the fact that as the ball is chewed, only the chewing surface of the teeth is cleaned whilst food particles between the teeth are not removed. Moreover, the ball is chewed at predefined positions between the teeth, depending on the way the user is used to chewing; the ball is not displaced all around inside the mouth leaving several places excluded from the cleaning action of the ball.

Another example of a tooth cleaning device adapted to be displaced within the mouth by means of the tongue is known from document DE 10033849.

This being the situation it would be highly desirable to have an improved tooth-cleaning device overcoming or at least partially limiting the drawbacks of the prior art.

SUMMARY OF THE PRESENT INVENTION

Generally, the present invention is directed to an handless cleaning device which can be easily displaced all around inside the mouth, thus allowing excellent cleaning results to be obtained.

In particular, the tooth-leaning device according to the present invention allows dental plaque to be efficiently removed and/or prevented.

Moreover, the tooth-cleaning device of the present invention allows teeth to be cleaned while exploiting daily activities and is therefore of practical use and not time consuming.

Additionally, the inventive tooth-cleaning device does not require the use of hands and/or arms and can therefore conveniently be used by disabled people with not upper body mobility.

The tooth-cleaning device of the present invention does not require water and can be discarded once the cleaning process has been completed.

Finally, the tooth-cleaning device according to the present invention can be shaped so as to meet the particular requirements of the user. The user can select the most preferred shape allowing the tooth-cleaning device to be efficiently displaced all around inside the mouth. The shape can even be modified during the cleaning process, allowing the user to exploit different cleaning purposes, during a single cleaning process.

For this purpose, according to a first embodiment as claimed in claim 1, the present invention relates to a tooth-cleaning device comprising a main body and a plurality of bristles carried by said main body, wherein the tooth-cleaning device comprises engaging means adapted to be engaged by the tongue and allowing said tooth-cleaning device to be displaced within the mouth by means of the tongue. Moreover, said main body is adapted to receive a dispersible substance which is naturally dispersed during use. In particular, said main body is impregnated with said dispersible substance.

Preferably, said dispersible substance can be selected between a flavoring substance or a toothpaste or a therapeutic substance.

According to a preferred embodiment as claimed in claim 5, the main body of the tooth-cleaning device of the present invention is a hollow body comprising an inner cavity defining a receiving portion adapted to receive at least a portion of the tongue.

In another preferred embodiment as claimed in claim 9, the main body of the tooth-cleaning device of the present invention defines a through hole.

According to a still preferred embodiment as claimed in claim 10, said main body has a ring or doughnut shape.

In another preferred embodiment as claimed in claim 18, said main body is deformable so that it can be shaped so as to form engaging means adapted to be engaged by the tongue and allowing said tooth-cleaning device to be displaced within the mouth by means of the tongue.

In particular, according to the preferred embodiment of the present invention as claimed in claim 21, the main body of the tooth-cleaning device comprises a flat strip adapted to be deformed so as to define a receiving portion adapted to receive at least a portion of the tongue.

According to the further preferred embodiments as claimed in one of claims 22 to 24, said flat strip can be deformed into a body having approximately a cylindrical shape, a thimble shape or a spherical shape.

In a still preferred embodiment as claimed in claim 25, the main body of the tooth-cleaning device according to the present invention comprises an elongated body of an approximately barret-like shape.

For example, said elongated main body can be deformed into an approximately ring shaped or doughnut shaped body, or into an approximately square shaped body or a polygonal-like shaped body with a predefined number of sides.

According to a further preferred embodiment, the main body of the tooth-cleaning device of the present invention is filled with a liquid dispersible substance which is released, during use, through small passages provided in said body.

In another preferred embodiment as claimed in claim 35, the main body of the tooth-cleaning device of the present invention is formed by a resilient material and a string or cord is provided to be hand-held by the user, thus preventing accidental ingestion of the tooth-cleaning device. Preferably, said resilient material is selected between gum, silicon or resin.

Additionally, according to the still preferred embodiment as claimed in claim 37, the main body of the inventive tooth-leaning device is inert, non-toxic and impervious to saliva.

According to another preferred embodiment as claimed in claim 38, adhesion improving means are provided to improve the adhesion of the tongue to the main body. Preferably, said additional improving means comprise resilient protrusions extending from the main body.

According to a further preferred embodiment as claimed in claim 42, the tooth-cleaning device of the present invention is embedded in a sweet or a drop or the like of a dispersible material adapted to be dissolved by the human saliva and/or by chewing.

Other preferred embodiments of the tooth-cleaning device according to the present invention are defined in the appended claims.

BRIEF DESCRIPTION OF THE DRAWINGS

Further advantages, objects and features of the present invention are defined in the appended claims and will become more apparent with the following detailed description when taken with reference to the accompanying drawings in which identical or corresponding parts are identified by the same reference numerals. In particular, in the drawings:

FIGS. 9*a* to 9*e* represent corresponding examples of bristles which can be provided on the main body of the tooth-cleaning device of the present invention.

DETAILED DESCRIPTION OF THE INVENTION

Figure 1A:
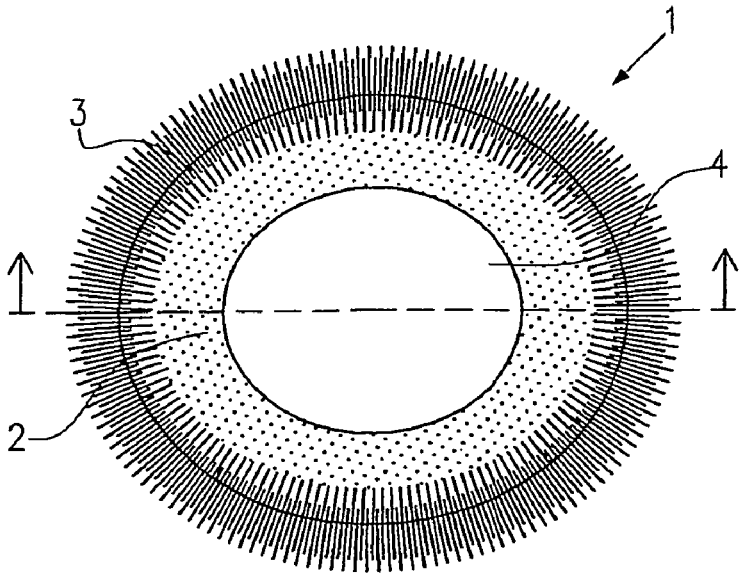
FIGS. 1*a* to 1*f* relates to a ring or doughnut shaped tooth-cleaning device according to a first embodiment of the present invention.

While the present invention is described with reference to the embodiments as illustrated in the following detailed description as well as in the drawings, it should be understood that the following detailed description as well as the drawings are not intended to limit the present invention to the particular illustrative embodiments disclosed, but rather the described illustrative embodiments merely exemplify the various aspects of the present invention, the scope of which is defined by the appended claims.

In the following, description will be given with reference to FIGS. 1*a* to 1*f* and 2*a* to 2*d* of a first embodiment of the tooth-cleaning device according to the present invention.

FIG. 1*a* represents a top view of the inventive tooth-cleaning device whilst FIGS. 1*b* to 1*f* relate to corresponding cross-sectional views. In FIGS. 2*a* to 2*d* some examples are given of corresponding embodiments having different shapes.

As depicted in FIG. 1*a*, the tooth-cleaning device 1 according to the first embodiment comprises a main body 2 and bristles 3 carried by said main body 2. The main body 2 defines a through hole 4 adapted to receive at least the end portion of the human tongue, thus allowing the tooth-cleaning device 1 to be engaged by the tongue so as to be displaced all around inside the mouth. As the tooth-cleaning device is displaced by the user into the mouth, the bristles 3 come into contact with the teeth and the gums so as to remove food particles. Once the cleaning process has been completed the tooth-cleaning device 1 is discarded.

The through hole 4 allows the tooth-cleaning device 1 to be engaged by the tongue, thus rendering it easy for the user to displace the tooth-cleaning device 1 all around inside the mouth. Preferably, the tooth-cleaning device 1 comprises an engaging portion adapted to be engaged by the tongue with said engaging portion being kept free from the bristles; for example, in the particular embodiment depicted in FIG. 1*b*, the main body 2 comprises a cylindrical surface 5 facing the through hole 4. As apparent from FIG. 1*b* no bristles are provided on the cylindrical surface 5 with the purpose of allowing the tongue to be easily received into the through hole 4. In fact, bristles on the cylindrical surface 5 could render it annoying or troublesome to engage the tooth-cleaning device 1 with the tongue.

Figure 1B:
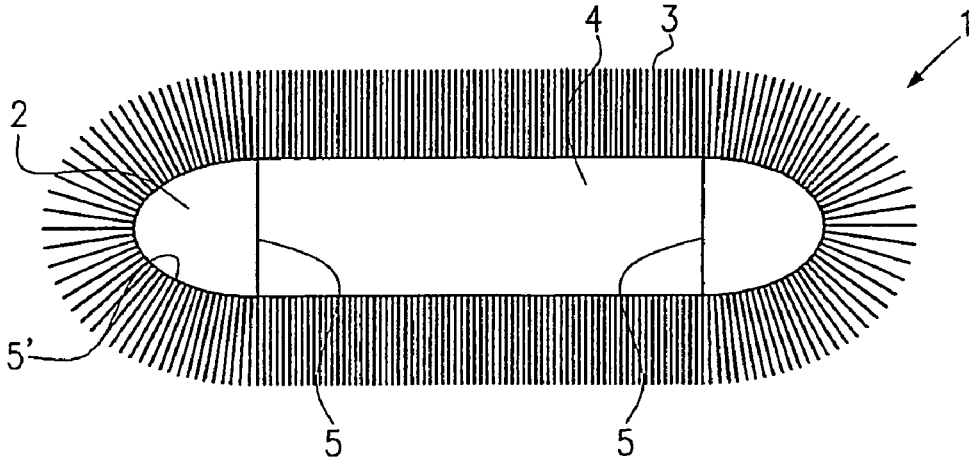
Figure 1C:
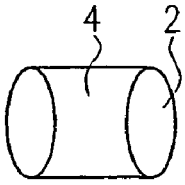
Figure 1D:
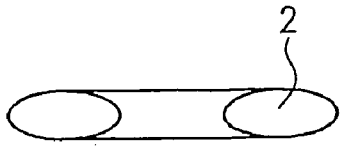
Figure 1E:
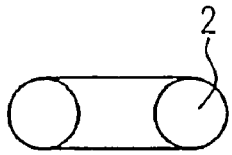
Figure 1F:
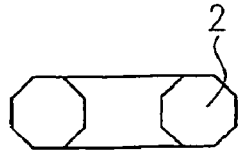

The main body 2 of the tooth-cleaning device 1 can have several preferred cross-sectional shapes; for instance, as apparent from FIG. 1*b*, the cross-sectional contour of the main body 2 can comprise a linear portion corresponding to the cylindrical surface 5 disclosed above, and a curved portion 5' joined to said linear portion. Other cross-sectional shapes fall within the scope of the present invention as apparent from FIGS. 1*c* to 1*f*, wherein the bristles have been omitted for clarity; for instance, as depicted in FIG. 1*e* an annular or doughnut shaped main body 2 can be realized, with said annular body having a circular cross-sectional shape. Alternatively, the annular main body 2 of the inventive tooth-cleaning device can have an oval cross-sectional shape as depicted in FIGS. 1*c* and 1*d*. In the particular embodiment of FIG. 1*c* the main body 2 has a cross-sectional shape which is elongated in the vertical direction with respect to the main body 2. In the particular embodiment depicted in FIG. 1*d*, the annular main body 2 has an oval cross-sectional shape which is elongated in the horizontal direction with respect to the main body 2. Finally, as depicted in FIG. 1*f*, the annular main body 2 can have a polygonal-like cross-sectional shape. In the particular embodiment depicted in FIG. 1*f* the polygonal cross-sectional shape comprises eight sides. However, any polygonal shape with a predefined number of sides can be selected, according to the circumstances.

As it will be described in more detail with reference to FIGS. 8*a* to 8*e*, the tooth-cleaning device 1 can be provided with adhesion improving means adapted to improve the adhesion of the tongue to the main body. For instance, in the particular embodiment depicted in FIG. 1*b* resilient protrusions can be provided on the cylindrical surface 5 or on that portion of the main body which is deputed to be engaged by the tongue.

Figures 2A, 2B, 2C, 2D:
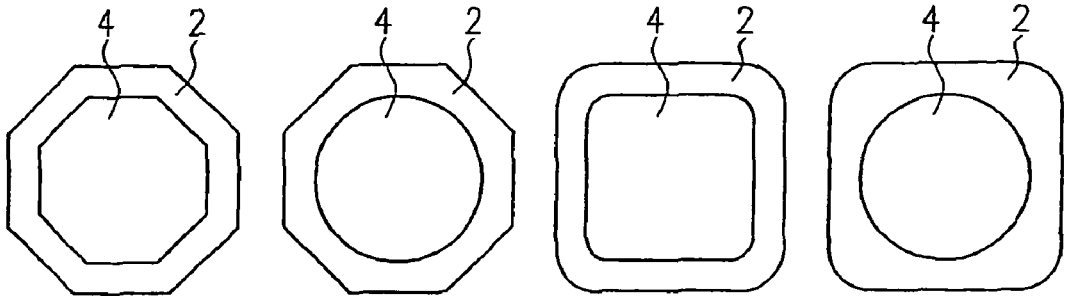
In FIGS. 2*a* to 2*d* there are depicted some preferred shapes of the main body of the tooth-cleaning device of the present invention.

In FIGS. 2*a* to 2*d* the main body 2 is depicted as having different shapes. For instance, in FIG. 2*a*, the main body 2 has a polygonal-like shape defining a polygonal-like through hole 4, whilst in FIG. 2*b* the polygonal shaped main body 2 defines a circular through hole 4. As depicted in FIG. 2*c* the main body 2 can also have a square shape defining a square through hole 4 or, alternatively, as depicted in FIG. 2*d*, the main body 2 can have a square shape defining a circular through hole 4.

It is understood that other shapes not depicted in the Figures fall within the scope of the invention and that the examples given are not intended to limit the present invention, but merely exemplify the various shapes the tooth-cleaning device of the present invention can have.

It is also understood that any of the different shapes depicted in FIG. 2*a* to 2*d* can be combined with any of the cross-sectional shapes depicted in FIGS. 1*a* to 1*f*. For instance, the polygonal shaped main body 2 of FIG. 2*a* can have a circular cross-sectional shape as depicted in FIG. 1*e* or even an oval cross-sectional shape as depicted in one of FIGS. 1*c* and 1*d*.

According to a preferred embodiment the main body 2 of the tooth-cleaning device is adapted to receive a dispersible substance, such as, for example a toothpaste or a flavoring substance or a therapeutic substance. For instance, said main body 2 can be filled with a liquid dispersible substance which is released, during use, through small passages (not depicted in the Figures) provided in said body. Alternatively, said main body 2 can be impregnated with said dispersible substance.

The main body 2 is preferably formed by a resilient material, such as for example gum, silicon, resin or the like.

The tooth-cleaning device of the present invention is preferably inert, non-toxic and impervious to saliva.

In the following, description will be given with reference to FIGS. 3*a* to 3*d* and 4*a* to 4*d* of a further embodiment of the tooth-cleaning device according to the present invention.

Figure 3A:
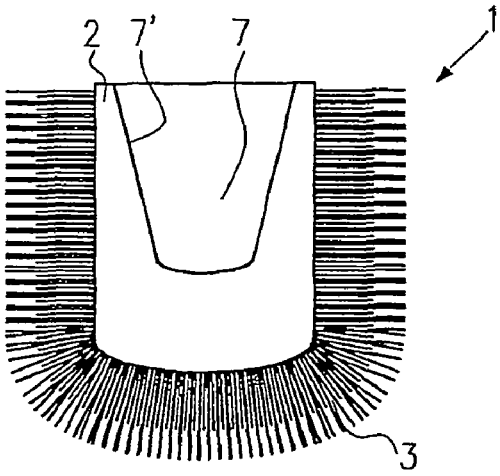
FIGS. 3*a* to 3*d* relate to further preferred embodiments of the tooth-cleaning device of the present invention.
Figure 3B:
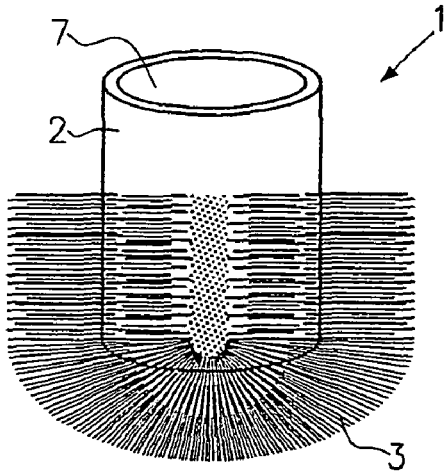

FIGS. 3*b* and 3*a* relate to a perspective view and a cross-sectional view of the tooth-cleaning device, respectively. As apparent from FIGS. 3*b* and 3*a*, the main body 2 according to the further embodiment depicted is a hollow body defining an inner cavity 7 communicating with the exterior through a receiving aperture. The inner cavity 7 is adapted to receive at least the end portion of the tongue, so that the tooth-cleaning device 1 can be engaged by the tongue so as to be displaced by the user all around inside the mouth. As depicted in the Figures, the inner cavity 7 can have any shape usual for receiving the end portion of the tongue. For instance, as depicted in FIGS. 3*a* and 3*d* the inner cavity 7 can have a taper shape. Alternatively, as depicted in FIG. 3*c* the inner cavity 7 can have a hollow cylindrical shape.

Figure 8A:
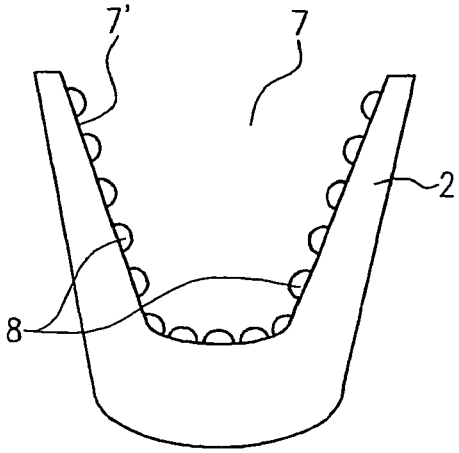
In FIGS. 8*a* to 8*e* some embodiments of the tooth-cleaning device of the present invention are depicted as comprising adhesion improving means.

As stated above, the inner cavity 7 is adapted to be engaged by the tongue. In order to improve the adhesion of the tongue with the inner surface 7' of the inner cavity 7, said inner surface 7' can be provided with adhesion improving means such as resilient protrusions 8 as depicted in FIG. 8*a*.

Alternatively, the inner surface 7' is kept free from said adhesion improving means but a shape for the inner cavity is selected, allowing a kind of vacuum effect to be obtained; so that the tooth-cleaning device can be conveniently displaced all around inside the mouth.

Figure 3C:
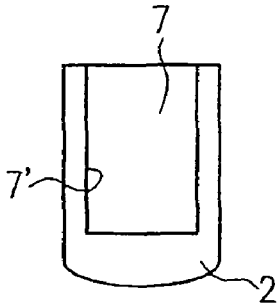
Figure 3D:
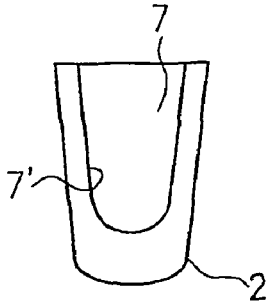

Also the exterior shape can be selected according to the circumstances as apparent from FIGS. 3*c* and 3*d*. In FIG. 3*c*, the main body 2 is depicted as having a hollow cylindrical shape while in FIG. 3*d* the main body 2 is depicted as having a thimble shape.

For clarity purposes, in FIG. 3*b* the bristles 3 are depicted as covering only partially the external surface of the main body 2. However, as apparent from FIG. 3*a*, said bristles 3 are preferably provided so as to cover the whole external surface of the main body 2. As apparent from FIG. 3*a* the edge of the inner cavity 7 as well as the inner surface 7' of the inner cavity 7 are preferably kept free from bristles. In fact, providing the bristles on the edge or even on the inner surface 7' of the inner cavity 7 could render it annoying or troublesome to engage the tooth-cleaning device with the tongue.

Figure 4A:
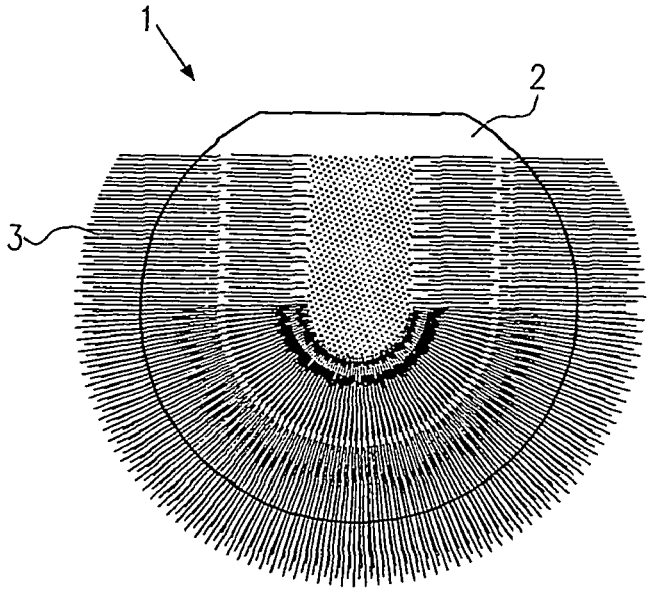
FIGS. 4*a* to 4*d* represent corresponding embodiments of the tooth-cleaning device of the present invention wherein the main body has a hollow spherical shape.
Figure 4B:
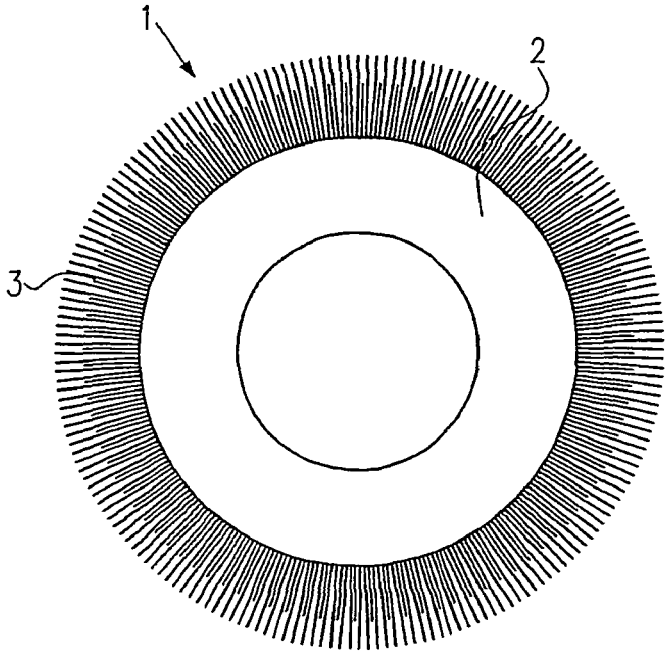
Figure 4C:
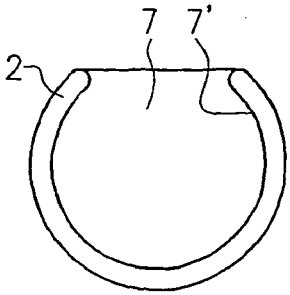
Figure 4D:
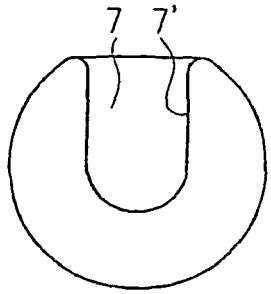

As depicted in FIGS. 4*a* to 4*b* the main body 2 can also have a spherical hollow shape defining an inner cavity 7 of a predefined shape. For instance, as depicted in FIG. 4*c* the inner cavity 7 can have a hollow spherical shape. Alternatively, as depicted in FIG. 4*d*, the inner cavity 7 can have a taper shape. Again, in the side view of FIG. 4*a* as well as in the top view of FIG. 4*b* the bristles 3 are depicted as covering only partially the external surface of the main body 2 for reason of clarity; however, said bristles 3 are preferably provided so as to cover the whole external surface of the main body 2. In the same manner as in the case of the tooth-cleaning device depicted in FIG. 3*a* to 3*d*, the edge of the inner cavity 7 of the spherical tooth-leaning device depicted in FIGS. 4*a* to 4*d* is normally kept free from cleaning bristles and adhesion improving means such as resilient protrusions can be provided on the edge of the inner cavity 7 as well as on the inner surface 7' of the inner cavity 7.

Of course, also the main body 2 of the tooth-cleaning device of the embodiment described with reference to FIGS. 3*a* to 3*d* and 4*a* to 4*d* can be adapted to receive a dispersible substance, such as, for example, a refreshing or flavoring substance, a toothpaste or a therapeutical substance. Said dispersible substance can either be filled into the main body 2 so as to be released during use through small passages provided in the main body 2 (not depicted in the Figures) or the main body 2 can be impregnated with said dispersible substance.

Preferably, gum, silicon or resin or the like are selected as materials for forming the main body 2 with said main body 2 being non-toxic, inert and impervious to saliva.

Further preferred embodiments of the tooth-cleaning device according to the present invention will be described in the following, with reference to FIGS. 5*a* to 5*d*, 6*a* to 6*d* and 7*a* to 7*d*. According to said preferred embodiments, the main body 2 of the tooth-cleaning device 1 is a deformable body, i.e. a body which can be deformed into any preferred shape. In particular, the tooth-cleaning device can be deformed for the purpose of rendering it easily engageable by the tongue, thus allowing it to be displaced all around inside the mouth by means of the tongue.

Figure 5A:
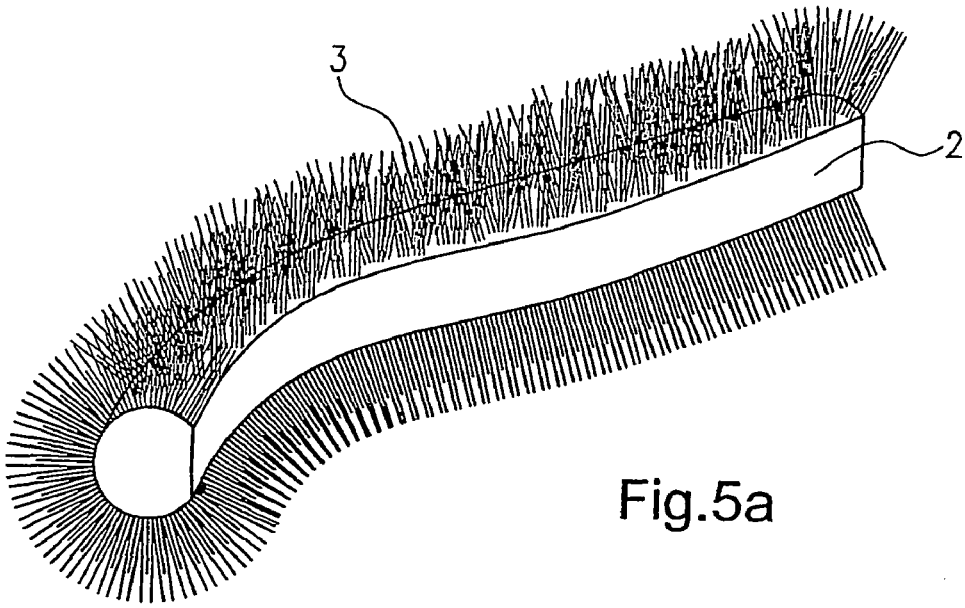
FIGS. 5*a* to 5*d* relate to a further embodiment of the present invention wherein the main body comprises a deformable, elongated barret-like main body.
Figure 5B:
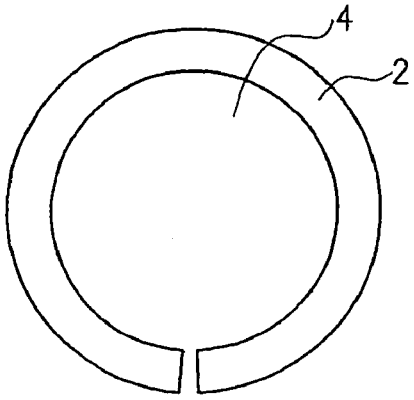
Figure 5C:
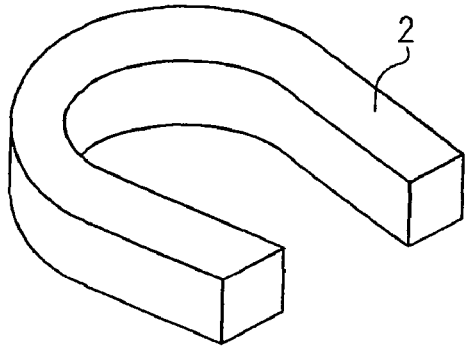
Figure 5D:
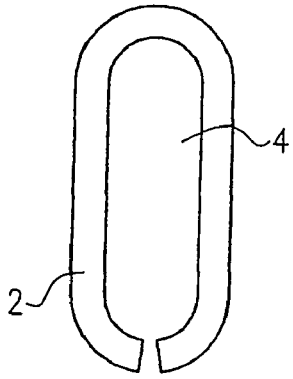

In the particular embodiment depicted in FIGS. 5*a* to 5*d*, the main body 2 has an elongated barret-like shape. Alternatively, as depicted in FIGS. 7*a* to 7*d* the main body 2 may comprise a flat, enlarged strip. In FIGS. 5*b* to 5*d* some examples have been given of the way the elongated barret-like main body 2 of FIG. 5*e* can be deformed so as to be easily engaged by the tongue. For instance, as depicted in FIG. 5*b* the elongated barret-like body 2 can be deformed into an annular ring defining a circular through hole 4. Alternatively, the main body 2 can be deformed so as to define an elongated through hole 4 as depicted in FIG. 5*d*. As a further example, the main body 2 can be deformed into a horseshoe shape as depicted in FIG. 5*c*.

Figure 6A:
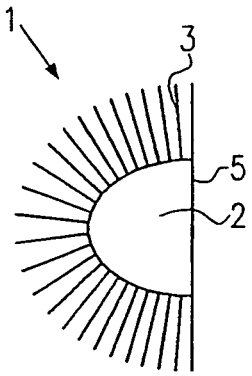
In FIGS. 6*a* to 6*d* there are depicted some preferred cross-sectional shapes of the elongated barret-like main body of FIGS. 5*a* to 5*d;*
Figure 6B:
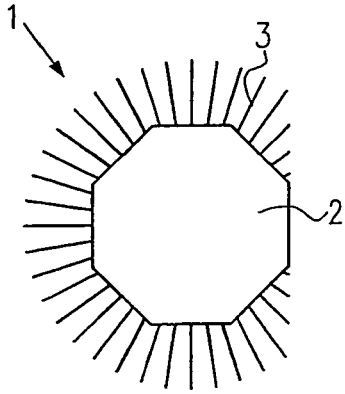
Figure 6C:
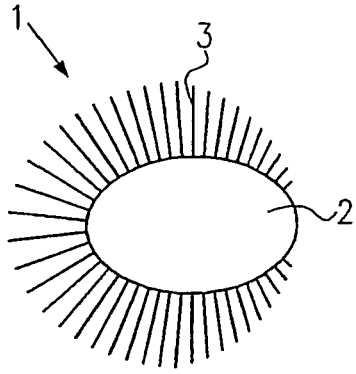
Figure 6D:
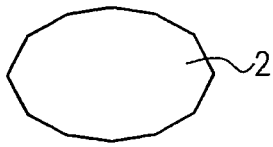

The elongated barret-like main body 2 can have any preferred cross-sectional shape as depicted in FIGS. 6*a* to 6*d*. For instance as depicted in FIG. 6*a* the main body may comprise a flat surface 5 and the cross-sectional contour of the barret-like main body 2 may comprise a linear portion corresponding to said flat surface and a curved portion 5 joined to said linear portion. Alternatively, the barret-like main body 2 can have a circular cross-sectional shape (not depicted in FIGS. 6*a* to 6*d*) or an oval cross-sectional shape as depicted in FIG. 6*c*, or a polygonal-like cross-sectional shape with a predefined number of sides as depicted in FIGS. 6*b* and 6*d*.

In the same manner as in the case of the first embodiment described above, a portion of the barret-like main body 2 is preferably kept free from the circular bristles so that the user can easily realize an engaging portion not covered by cleaning bristles, and being adapted to be engaged by the tongue.

Figure 7A:
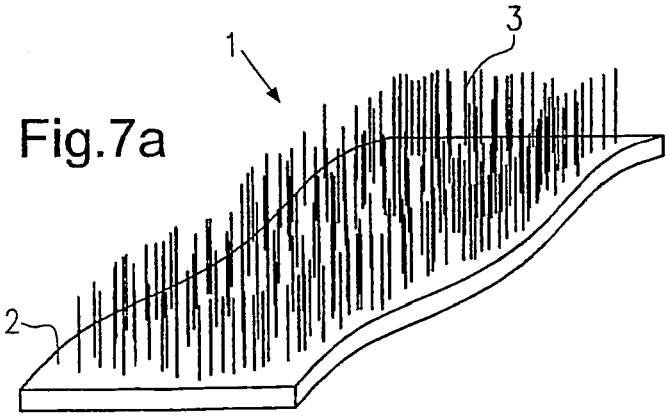
FIGS. 7*a* to 7*d* relate to a further embodiment of the tooth-cleaning device of the present invention wherein the main body comprises a deformable flat strip.
Figure 7B:
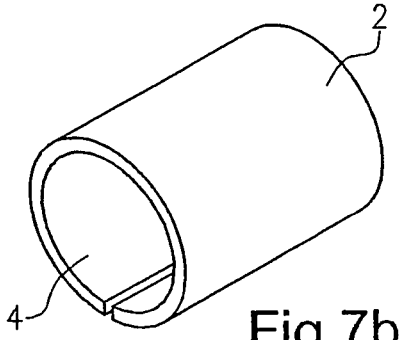
Figure 7C:
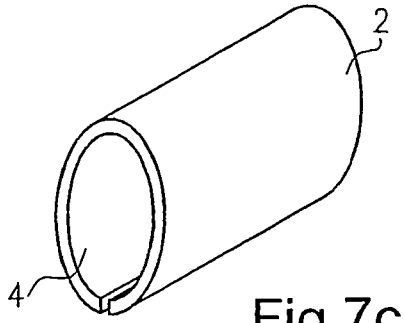
Figure 7D:
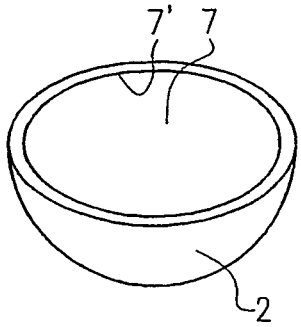

In the case in which the deformable main body 2 comprises an enlarged flat strip, said flat strip can be easily deformed into a tubular shape having either a circular cross-sectional shape as depicted in FIG. 7*b* or an elongated oval cross-sectional shape as depicted in FIG. 7*c* or even a horseshoe bat cross-sectional shape (not depicted in FIGS. 7*a* to 7*d*). As a further example, the flat strip 7*a* can be deformed into a hollow body as depicted in FIG. 7*d*, with said hollow body having a shape approximately corresponding to the several shapes described with reference to FIGS. 3*a* to 3*d* and 4*a* to 4*e*.

Obviously, the deformable main body 2 of the present embodiment can also be filled with a dispersible substance, such as a flavoring substance or a toothpaste or therapeutic substance with said substance being released, during use, through small passages provided into said main body. Alternatively, the deformable main body 2 can be impregnated with said dispersible substance.

The deformable main body 2 of the present embodiment is non-toxic inert and impervious to salvia.

Figure 8B:
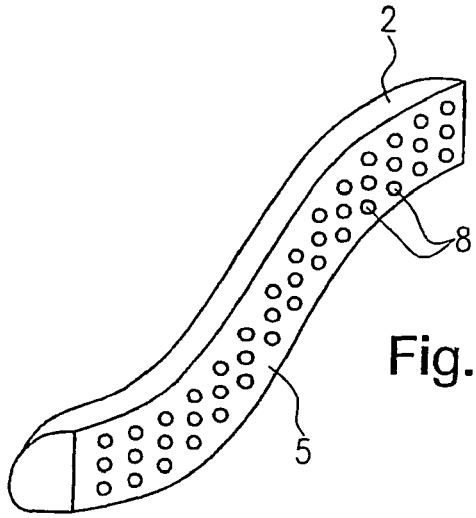
Figure 8C:
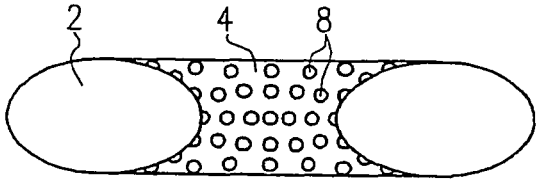
Figure 8D:
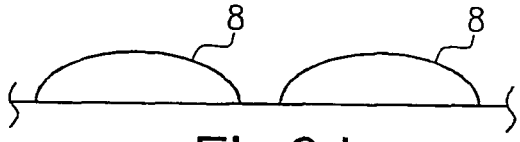
Figure 8E:
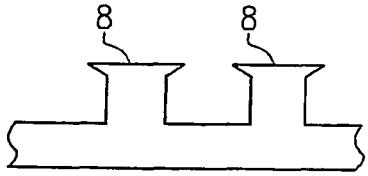

In FIGS. 8*a* to 8*e*, examples are given of the way the different embodiments described can be provided with adhesion improving means 8. In particular, in FIG. 8*a* the thimble shape hollow body 2 described above with reference to FIGS. 3*a* to 3*d* is depicted as comprising resilient protrusions 8 disposed on the inner surface 7' of the inner cavity 7. In FIG. 8*b* the deformable elongated barret-like main body 2 is represented as being equipped with said resilient protrusions 8 covering a flat surface 5 of said main body 2. As a further example, FIG. 8*c* relates to a cross-sectional view of an annular main body 2 wherein the resilient protrusions 8 have been provided so as to face the through hole 4. The resilient protrusions 8 may have any preferred shape as depicted in FIGS. 8*e* and 8*d*.

Figure 9A:
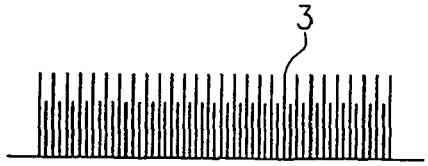
Figure 9B:
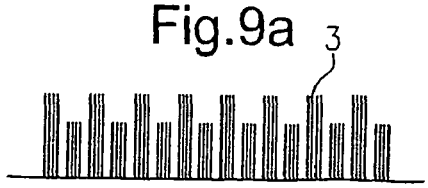
Figure 9C:
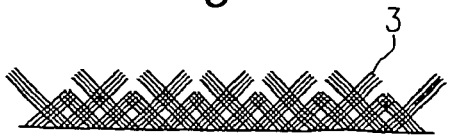

Finally, with reference to FIGS. 9*a* to 9*c*, examples are given of cleaning bristles the tooth-cleaning of the present invention may be equipped with. As apparent from FIG. 9*a*, the cleaning bristles may be of two different lengths. The cleaning bristles may also be arranged in tuffs as depicted in FIGS. 9*b* and 9*c*. Finally, as depicted in FIG. 9*c* the bristles can extend at an angle from the main body.

Preferably, the material forming the bristles comprises nylon.

All the embodiments of the tooth-cleaning device of the present invention as described above may be provided with a piece of cotton or a string or even a cord (not depicted in the Figures) to be hand-held by the user for the purpose of preventing accidental ingestion; this is particular convenient when the tooth-cleaning device is used by children.

According to a further preferred embodiment the tooth-cleaning device of the present invention can be embedded in a sweet or a drop or the like; after having been put into the mouth, the material forming the sweet or drop is dissolved by the saliva or by chewing. Once the drip is dissolved, the tooth-cleaning device is displaced all around inside the mouth and a cleaning process as described above can be performed.

The drop or sweet may comprise a flavoring substance or a therapeutic substance whilst sugar containing materials are preferably avoided.

Figure 10A:
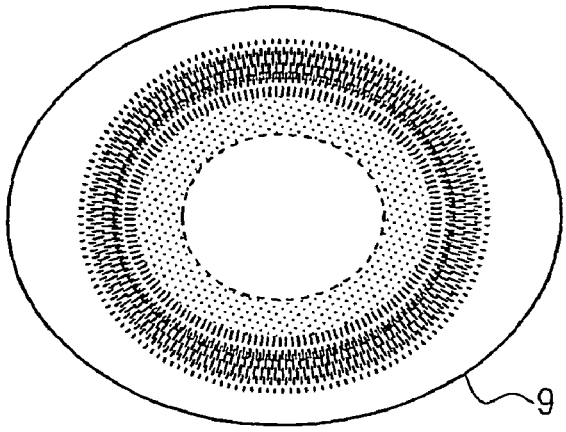
In FIGS. 10*a* to 10*c* there are depicted corresponding examples in which the inventive cleaning device is embedded in a drop of a dispersible material.
Figure 10B:
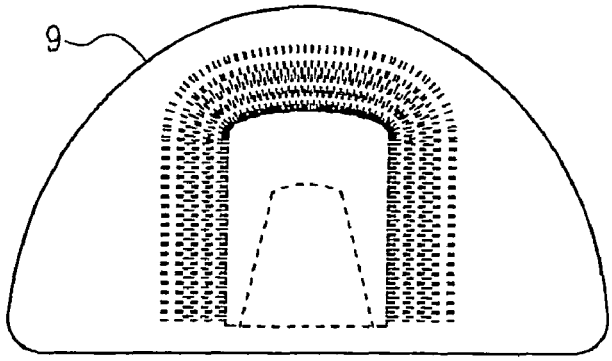
Figure 10C:
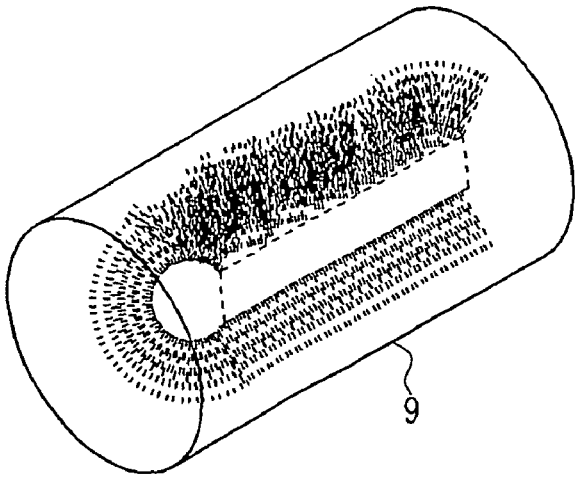

Depicted in FIGS. 10*a* to 10*c* are corresponding examples in which the tooth-cleaning devices of FIGS. 1*a*, 3*a* and 5*a*, respectively, are embedded in a drop 9 of a dispersible material.

In conclusion, an inventive tooth-cleaning device has been disclosed, which shows the following advantages and/or differences with respect to prior art tooth-cleaning devices.

The inventive tooth-cleaning device is not to be chewed but the cleaning action is exploited by displacing the inventive tooth-cleaning device all around inside the mouth by means of the tongue.

For this purpose, the inventive tooth-cleaning device comprises engaging means to be engaged by the tongue. By displacing the inventive tooth-cleaning device all around inside the mouth not only the chewing surface of the teeth is cleaned but food particles are efficiently removed from crevices between the teeth, the gums are stimulated and dental plague is properly removed.

The inventive tooth-cleaning device can be used in any situation in which water is not at immediate disposal and once used can be discarded.

The inventive tooth-cleaning device may be conveniently used by disabled or handicapped people.

The inventive tooth-cleaning device allows a thorough cleaning program to be exploited in a non-time consuming manner and can therefore be conveniently used by those busy people who are reluctant to take the time for dental cleaning.

Of course, it should be understood that a wide range of changes and modifications can be made to the embodiments described above. It is therefore also understood that it is the claims, including all equivalence, which are intended to define the scope of the invention. It is finally to be understood that the forms and/or shapes of the tooth-cleaning device according to the present invention shown and described herein are to be constructed as the presently preferred embodiments.

The invention claimed is:

1. A tooth-cleaning device comprising:

an inner main body;

engaging means, formed within said inner main body, for engaging a human tongue;

a dispersible substance filled within said inner main body, wherein said dispersible substance is released through passages provided in said inner main body; and bristles covering an outer surface of said inner main body, whereby when placed by a user in the mouth, the bristles come into contact with the teeth and the gums so as to remove food particles and said dispersible substance is released from said inner main body.

2. A tooth-cleaning device as in claim 1 wherein:

said engaging means comprises a through hole.

3. A tooth-cleaning device as in claim 1 wherein:

said engaging means comprises an inner cavity.

4. A tooth-cleaning device for placement inside a human mouth and engaged by a human tongue comprising:

an inner main body having a doughnut shape with a through hole and an inner cylindrical surface, wherein the through hole is adapted to engage the human tongue;

a dispersible substance filled within said inner main body, wherein said dispersible substance is released through passages provided in said inner main body; and bristles covering an outer surface of said inner main body, whereby when placed by a user in the human mouth, said bristles come into contact with the teeth and the gums so as to remove food particles and said dispersible substance is released from said inner main body.

5. A tooth-cleaning device for placement inside a human mouth and engaged by a human tongue as in claim 4 wherein:

said bristles comprise nylon.

6. A tooth-cleaning device for placement inside a human mouth and engaged by a human tongue as in claim 4 wherein:

said inner main body has a cross section comprising a linear portion and a curved portion.

7. A tooth-cleaning device for placement inside a human mouth and engaged by a human tongue comprising:

an elongated main body that is deformable having a cross section comprising a linear portion and a curved portion, whereby a shape having a through hole can be formed by deforming said elongated main body;

a dispersible substance filled within said elongated main body, wherein said dispersible substance is released through passages provided in said elongated main body; and bristles covering the curved portion only of said elongated main body, whereby when said elongated main body is deformed into the shape having a through hole and placed by a user in the human mouth, said bristles come into contact with the teeth and the gums so as to remove food particles and said dispersible substance is released from said elongated main body.

* * * * *